US005583781A

United States Patent [19]

Denz et al.

[11] Patent Number: 5,583,781

[45] Date of Patent: Dec. 10, 1996

[54] PROCESS AND DEVICE TO CORRECT THE REGULATION ONSET POINT AND THE INTENSITY OF REGULATION

[75] Inventors: Peter Denz, Hohenwart; Johann-Christian Promoli, Ingolstadt, both of Germany

[73] Assignee: Rieter Ingolstadt Spinnereimaschinenbau AG, Ingolstadt, Germany

[21] Appl. No.: 296,086

[22] Filed: Aug. 25, 1994

Related U.S. Application Data

[63] Continuation of Ser. No. 983,579, Feb. 4, 1993, abandoned.

[30] Foreign Application Priority Data

Jun. 4, 1991 [DE] Germany ..... 41 18 242.1
May 13, 1992 [DE] Germany ..... 42 15 682.3

[51] Int. Cl.[6] ..... G06F 19/00

[52] U.S. Cl. ..... 364/470.01; 19/236

[58] Field of Search ..... 364/470, 468, 364/471, 162; 19/239, 240, 236, 237, 238, 294

[56] References Cited

U.S. PATENT DOCUMENTS

| | | |
|---|---|---|
| 4,847 | 11/1846 | Pray et al. . |
| 7,165 | 3/1850 | Hayden . |
| 7,919 | 1/1851 | Wyllys . |
| 68,741 | 9/1867 | Herrschaft . |
| 86,719 | 2/1869 | Whitton . |
| 110,556 | 12/1870 | Draper . |

(List continued on next page.)

FOREIGN PATENT DOCUMENTS

| | | |
|---|---|---|
| 0412448 | 2/1991 | European Pat. Off. . |
| 1195177 | 11/1959 | France . |
| 1237428 | 6/1960 | France . |
| 720200 | 4/1942 | Germany . |
| 1097328 | 1/1961 | Germany . |
| 1287484 | 9/1969 | Germany . |
| 2331217 | 1/1975 | Germany . |
| 3619248 | 12/1987 | Germany . |

(List continued on next page.)

OTHER PUBLICATIONS

"A Survey of Autolevelling at the Drawframe" by David J. Goetzinger, Dec. 1, 1976.
"Design, Construction, and Performance of Saco–Lowell/Uster Versa–Matic ADC Draw Frame", by Paul B. West, Jun. 1, 1960.
"Saco–Lowell Uster Versamatic Automatic Draw Frame Draft Control".
"Platt Group Bulletin" vol. 11, No. 3, Autolevelling at the Drawframe.
"Automatic Eveners: What They Do, How They Work" by Dr. Hugh M. Brown, Textile World, Feb., 1966.
"Simulation of a Textile Machine Process Control System", Atomic Weapons Research Establishment AWRE Report No. 0–71/66, by K. G. Beauchamp, Oct., 1966.
"Draw Frame With Servo Controlled Draft" Saco–Lowell Shops, Boston, U.S.A.
Electronics in Textile Machines—Carding Machine Control, Industrial Electronics, May, 1965.
International Search Report.

*Primary Examiner*—Roy N. Envall, Jr.
*Assistant Examiner*—Brian C. Oakes
*Attorney, Agent, or Firm*—Dority & Manning

[57] ABSTRACT

A process and a device for the correction of the regulation onset point and of the intensity of regulation relate to a regulated drawing frame of the textile industry, i.e. a drawing frame in which drafting can be regulated or can be changed in a controlled manner. A selected transient signal of the fiber sliver thickness starts the process for a limited time span so that, independently of the existing regulation, the response signal is detected at the drawing frame output and its difference with the input signal is evaluated in order to correct the regulation onset point and/or the intensity of regulation.

21 Claims, 4 Drawing Sheets

U.S. PATENT DOCUMENTS

| | | |
|---|---|---|
| 117,098 | 7/1871 | Moon . |
| 164,452 | 6/1875 | Herschaft . |
| 216,630 | 6/1879 | Reilley . |
| 278,488 | 5/1883 | Ayers . |
| 284,585 | 9/1883 | Whitehead . |
| 352,701 | 11/1886 | Matteson . |
| 387,701 | 8/1888 | Upton . |
| 389,695 | 9/1888 | Evans . |
| 392,172 | 10/1888 | Wilkins . |
| 447,200 | 2/1891 | Peirce . |
| 449,477 | 3/1891 | Hildreth . |
| 466,410 | 1/1892 | Hadfield . |
| 565,084 | 8/1896 | Mathewson . |
| 655,934 | 8/1900 | Mathewson . |
| 690,596 | 1/1902 | Mathewson . |
| 786,242 | 3/1905 | Westcott et al. . |
| 887,281 | 5/1908 | Smith . |
| 1,111,290 | 9/1914 | Birch et al. . |
| 1,132,316 | 3/1915 | Eves . |
| 2,141,003 | 3/1936 | King et al. . |
| 2,407,100 | 9/1946 | Richardson . |
| 2,681,475 | 6/1954 | Raper . |
| 2,746,093 | 5/1956 | Raper . |
| 2,810,936 | 10/1957 | Altenburger . |
| 2,890,494 | 6/1959 | Raper . |
| 2,891,287 | 6/1959 | Raper . |
| 2,930,084 | 3/1960 | Sanborn et al. . |
| 2,950,508 | 8/1960 | Locher . |
| 2,964,803 | 12/1960 | Robinson . |
| 2,981,986 | 5/1961 | Neil . |
| 3,016,460 | 1/1962 | Andresen . |
| 3,099,048 | 7/1963 | Locher . |
| 3,113,350 | 12/1963 | Selby . |
| 3,244,863 | 4/1966 | Paterson . |
| 3,246,916 | 8/1966 | Owen . |
| 3,314,114 | 4/1967 | Wyatt . |
| 3,440,690 | 4/1969 | Greenwood et al. . |
| 3,557,615 | 1/1971 | Seymour, Jr. et al. . |
| 3,703,023 | 11/1972 | Krauss et al. . |
| 3,768,122 | 10/1973 | Rauch . |
| 3,795,851 | 3/1974 | Gage et al. . |
| 3,822,590 | 7/1974 | Tharpe et al. . |
| 3,827,106 | 8/1974 | Varga . |
| 3,862,473 | 1/1975 | Felix et al. . |
| 3,869,759 | 3/1975 | Savageau et al. . |
| 3,885,232 | 5/1975 | Goto . |
| 3,925,850 | 12/1975 | Lytton . |
| 3,938,223 | 2/1976 | Grice . |
| 4,030,082 | 6/1977 | Goto . |
| 4,030,635 | 6/1977 | Hablutzel et al. . |
| 4,051,722 | 10/1977 | Feller . |
| 4,099,297 | 7/1978 | Hasegawa et al. . |
| 4,137,487 | 1/1979 | Niestroj et al. . |
| 4,163,927 | 8/1979 | Grice, Jr. . |
| 4,369,550 | 1/1983 | Meile . |
| 4,653,153 | 3/1987 | Felix et al. . |
| 4,812,993 | 3/1989 | Konig et al. ..... 364/470 |
| 4,819,301 | 4/1989 | Konig et al. . |
| 4,860,406 | 8/1989 | Stäheli et al. ..... 19/240 X |
| 4,864,694 | 9/1989 | Konig et al. ..... 19/239 X |
| 4,864,853 | 9/1989 | Grunder et al. ..... 19/240 X |
| 4,974,296 | 12/1990 | Vidler . |
| 5,014,395 | 5/1991 | Stäheli et al. ..... 19/240 X |
| 5,018,248 | 5/1991 | Haworth ..... 19/240 |
| 5,052,080 | 10/1991 | Gründler ..... 19/239 X |
| 5,134,755 | 8/1992 | Jornot et al. ..... 364/470 X |
| 5,230,125 | 7/1993 | Clement et al. ..... 19/115 |
| 5,412,301 | 5/1995 | Jornot et al. ..... 318/640 |

FOREIGN PATENT DOCUMENTS

| | | |
|---|---|---|
| 401758 | 2/1974 | U.S.S.R. . |
| 1144 | of 1860 | United Kingdom . |
| 3962 | of 1873 | United Kingdom . |
| 779197 | 7/1957 | United Kingdom . |
| 855949 | 12/1960 | United Kingdom . |
| 891321 | 3/1962 | United Kingdom . |
| 979346 | 1/1965 | United Kingdom . |
| 1135752 | 12/1968 | United Kingdom . |
| 1436029 | 5/1976 | United Kingdom . |
| 1443258 | 7/1976 | United Kingdom . |

PROCESS AND DEVICE TO CORRECT THE REGULATION ONSET POINT AND THE INTENSITY OF REGULATION

This is a continuation of U.S. application Ser. No. 07/983,579 filed Feb. 4, 1993 which was abandoned upon the filing hereof.

BACKGROUND OF THE INVENTION

The instant invention relates to a regulated drawing frame of the textile industry, i.e. a drawing frame in which draft is controlled or controllably adjustable. The concept of control comprises in this case the application of controls or of a multi-looped control system.

In this invention fiber slivers are processed and the thickness of the end-product must be uniform. It is the task of the control system to recognize a change in fiber sliver thickness and to bring it to the desired uniform thickness by drafting.

The thickness signals are detected at the measuring station before the inlet of the drawing frame. All along the subsequent course taken by the measured points in the fiber sliver, and up to the place where drafting occurs, the appertaining measuring signal is buffer-stored with a delay time. At the end of this delay time the control system intervenes immediately as a function of the deviation of the fiber sliver thickness. This onset of this control application is called the regulation onset point.

The problem in this case is that the regulation onset point must occur neither too early nor too late with respect to the onset of drafting because this would result in faulty drafting. Similarly, the intensity of regulation, i.e. the amplification, may be neither too low nor too high.

In practice, influences attributable to the machine or environmental influences are the cause that the drafting point cannot be determined precisely, and therefore errors occur in determining the regulation onset point and the intensity of regulation.

When erratic fluctuations of fiber sliver thickness occur, for example as a result of needle impulses exceeding the tolerance limits, the mechanical components are unable to follow quickly enough in driving the drawing frame rollers because of their inertia. Complete compensation for the variations in thickness is hardly possible in this case. The problem is aggravated by the existing need to increase the speed of the fiber sliver from an average of 500 m per minute to 800 m per minute and more.

Thickness fluctuations which increase very slowly over time are yet another extreme case. Here the reaction of regulation is also insufficient.

DE-OS 36 19 248 proposes that a correction value be determined for the delay period as a function of the steepness or the relative magnitude of mass fluctuation. The result is a shorting of the delay time as a function of the steepness and magnitude of the mass fluctuation. This solution has the disadvantage that the result of regulation cannot be checked. This is a disadvantage insofar as the correction made can be subject to influences attributable to the machine or by environmental influences.

The solution according to EP 412 448 proposes the utilization of a multi-looped control system on the drawing frame, whereby the measuring signal is detected and evaluated after the drawing frame output. The proposed solution here is to ascertain the result of controlled drafting change through supervision along the drawing frame course, to re-enter it into the same control system and to evaluate it in an optimization process broken down into low-frequency and high-frequency portions. The setting magnitude Y which is optimized by the main control is thus used as a setting value for the controller 8.2 of the drive of the main drafting zone 12 (EP 412 488, page 12, lines 12 –15). This solution is mainly based on the utilization of the measured values in order to always optimize the setting value. The clear drawback in this method is the fact that correction values to be used to set the setting values are not processed independently by the control system, and are therefore not free from influences.

To be able to detect changes in the regulation with certainty and independently of the regulation, the "sliver test" was conducted in the past. The "sliver test" is conducted by spot-checking and manually determining the correct levelling out of fluctuations in fiber sliver thickness. A test sliver is produced. The operator adds an individual sliver segment to the presented slivers or produces a limited sliver interruption through sliver breakage. The length of this created fiber sliver is cut out and its actual sliver thickness is determined by weighing (see instruction manual of the RIETER Spinning Systems, drawing frame RSB 851, SB 851, point 4.5.6, edition 8/1990). It is thus impossible to avoid an interruption of production counted in minutes. This is a considerable disadvantage in continuous production at high production speeds.

OBJECTS AND SUMMARY OF THE INVENTION

It is the object of the instant invention to create a process and a device which improves the correction of the regulation onset point and of the intensity of regulation in regulating the drawing frame. Additional objects and advantages of the invention will be set forth in part in the following description, or will be obvious from the description, or may be learned by practice of the invention.

Contrary to existing control methods utilizing the FFT analysis to obtain correction values, the method according to the invention has as one of its characteristics the selection of merely individual occurrences of fiber thickness in order to start the process which functions independently of the existing control system in order to determine and to carry out necessary corrections of the control system (i.e. correction of the regulation onset point or of regulating intensity) within a predetermined time span. The process according to the invention is therefore not constantly in operation. The process is started up only when a special signal is detected and is stopped after a predetermined time span.

This process does not involve a feedback of the control magnitude in the sense of a closed control circuit or of an interference magnitude lock-on.

The process consists in obtaining a transient signal of the fiber sliver thickness at the measuring station. The transient signal must possess high amplitude so that it is evident during a sufficiently long period of time that the fiber thickness is exceeding tolerance limits. At the same time, this amplitude must be steep enough to differentiate from a constantly increasing fiber thickness, but be less steep than for a needle impulse.

This signal must resemble a surge signal. This surge signal is transmitted to the control system and is utilized at the same time to start the correction process of the regulation onset point and of the intensity of regulation. The response signal is detected as an impulse diagram at the drawing frame output independently of current regulation and its deviation from the surge signal is evaluated in order to correct the regulation onset point and the intensity of regulation. The process is terminated after a defined time span.

Parallel to the existing control system, component groups are installed in the device which make it possible to recognize a transient signal as well as to evaluate the response signal with respect to the regulation onset point and to the regulating intensity.

The advantage of the process consists in the fact that it functions independently and is therefore free of influences from an existing regulation. The correction value is thus defined more precisely, since internal machine influences and environmental influences upon the drafting point can be taken into account with greater precision. Linked to this advantage is the further advantage of partial automation of the "sliver test" , in that a test sliver is produced automatically without interruption of the production process.

Since the process requires the targeted selection of a random individual occurrence of abnormal fiber sliver thickness, the process requires no constant operating mode.

The functioning of the process and its interaction with a known regulating system is described below through figures in an embodiment of the invention.

DETAILED DESCRIPTION OF THE PREFERRED EMBODIMENTS

Figure 1:
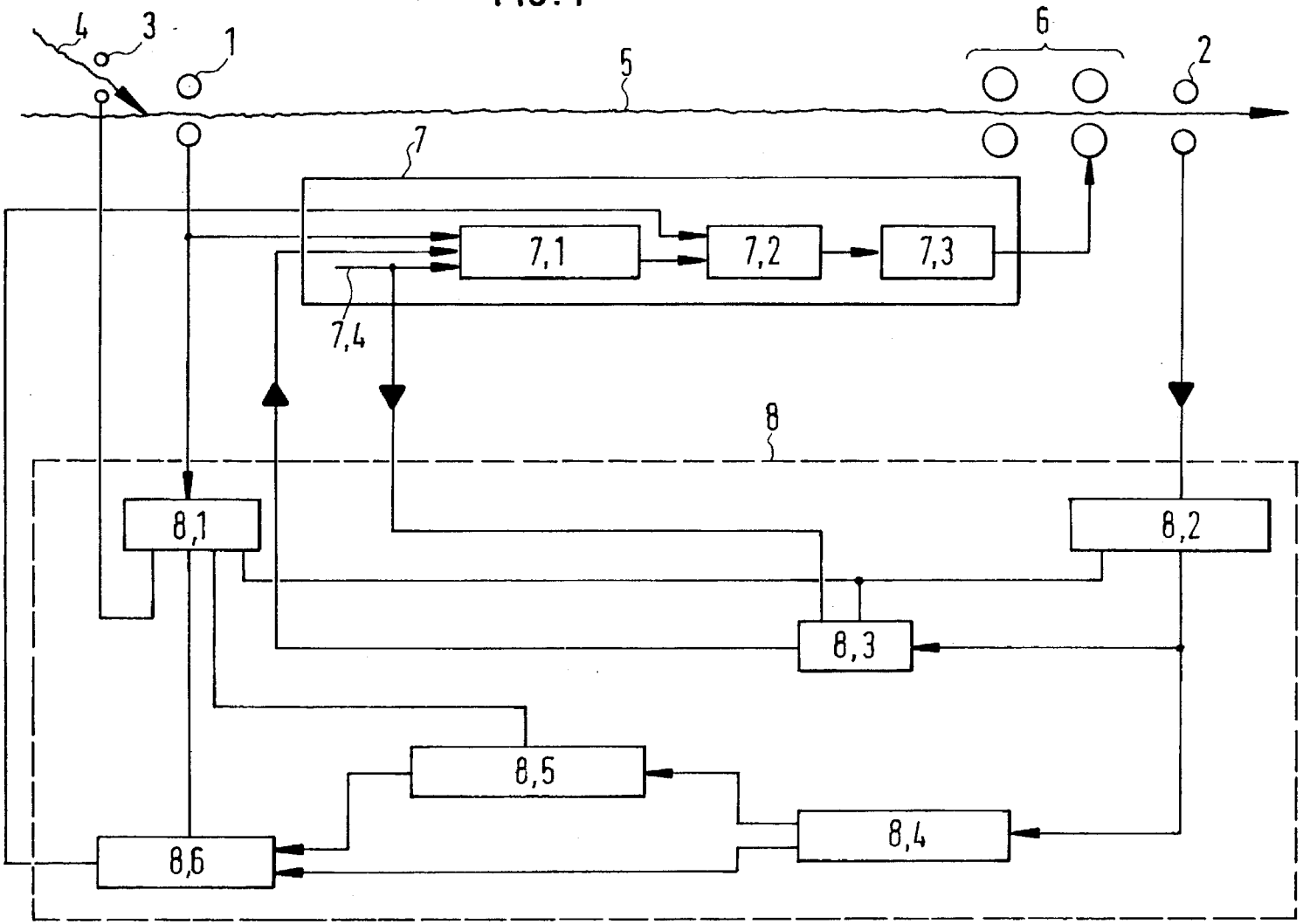
FIG. 1 is a modular mimic display depicting the process and the device of the invention.

Reference will now be made in detail to the presently preferred embodiments of the invention, one or more examples of which are illustrated in the drawings. Each example is provided by way of explanation of the invention, not limitation of the invention. The numbering of components in the drawings is consistent throughout the application, with the same components having the same number in each of the drawings.

FIG. 1 shows the modular mimic display pertaining to the process according to the invention with the essential characteristics of the device. The fiber sliver 5 runs through a measuring station 1. This measuring station 1 can be a mechanical pair of scanning rollers, for example. The draw-in rollers of reserve sliver feed 3 together with reserve sliver 4 are shown upstream of the measuring station 1. The fiber sliver is drafted in drawing frame 6. At the output of the drawing frame a measuring station 2 is provided. The conventional regulating system 7 receives the measuring signals from measuring station 1. These measuring signals are stored in a measured-value memory 7.1 with an appropriate delay time and are then transmitted to an amplifier 7.2, with the signal being transmitted from the output of the amplifier 7.2 to an adjusting element 7.3. The adjusting element 7.3 changes the rotational speed of a pair of rollers in the drawing frame 6 so that drafting is changed.

A component group 8 was installed in the device to implement this described regulating system 7. This component group 8 of the process according to the invention functions parallel to and independently of the conventional control regulating system 7. Shown in the component group 8 are a regulating circuit 8.1, a measured-value evaluating unit 8.2, a counting and evaluating unit 8.3 and a mean-value former 8.4, a buffer memory 8.5 and a comparator 8.6.

It is the task of a reserve sliver feed system to avoid production stoppages caused by fiber sliver breakage or by sliver ends in a can. The function of the reserve sliver feed system 3 is transferred to another area of application for the purpose of the invention. The reserve sliver feed system 3 is used in double function as part of a device to carry out the process.

One of the ways to start the process is for the regulating circuit 8.1 to transmit a starting signal to the reserve sliver feed system 3. At the end of a defined period of reserve sliver feeding, the reserve sliver feed system 3 is stopped. The length of that period is equal to the time required for the process.

Figure 3:
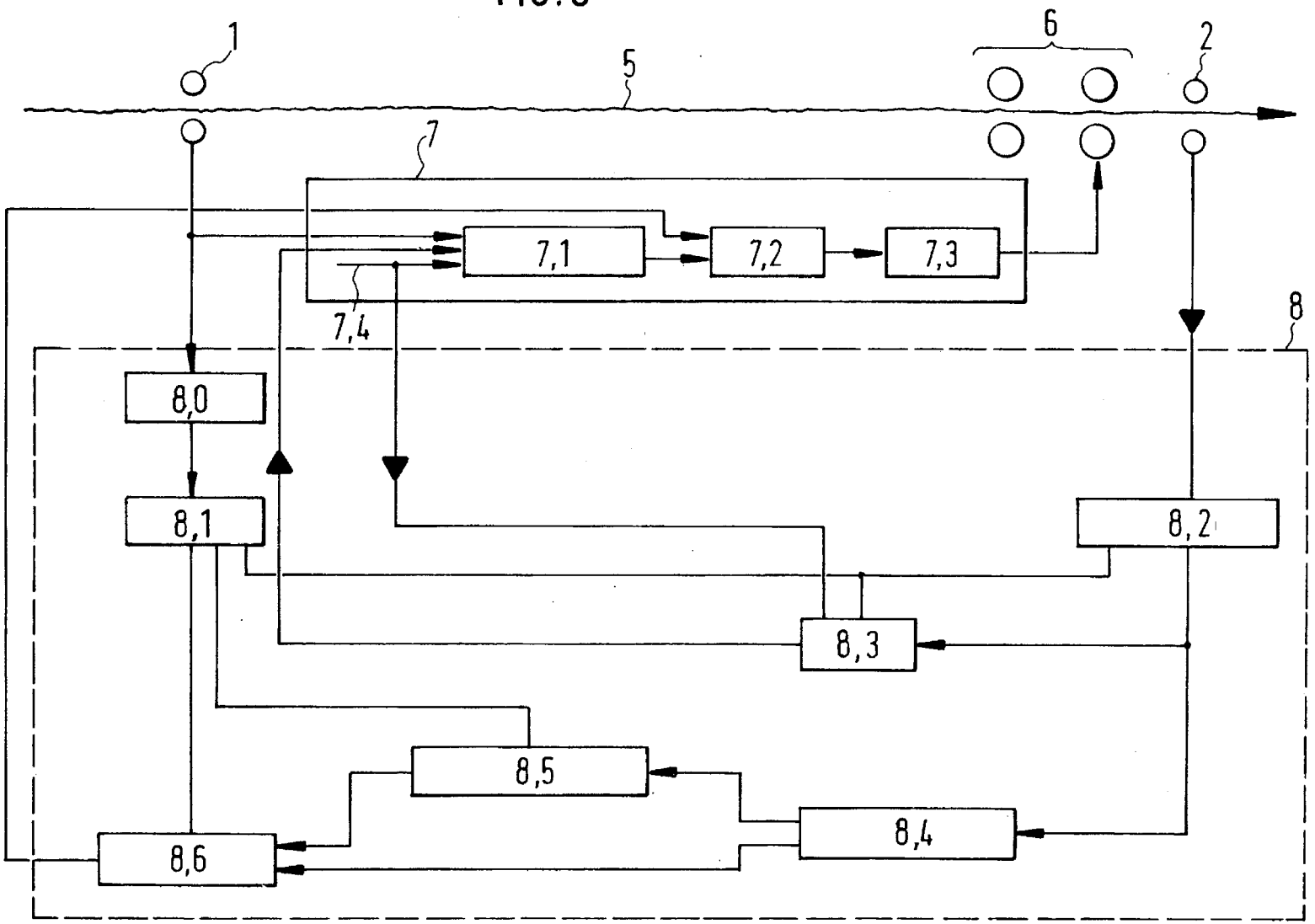
FIG. 3 is a representation of modular mimic display depicting the process and the device without reserve sliver feed.

Another way to start the process is provided by the presented slivers themselves. This possibility is shown in FIG. 3.

The presented slivers themselves can produce a transient signal at the measuring station 1 upstream of drawing frame 6 through a random deviation in fiber thickness. For this it is necessary that the transient signal possess high amplitude. The amplitude must differ by approx. 10% from the mean value and a time span (at least three clocking impulses of the measuring impulse) must be present. This signal must be recognized. For this purpose a measured-value analysis system 8.0 is installed between the measuring station 1 and the regulating circuit 8.1 (FIG. 3). A comparison value is defined by the mean of the measured-value analysis system 8.0 by constituting long-term mean values of the measured values. When the comparison value is exceeded by at least 10%, this is recorded as a threshold excess by the measured-value analysis system 8.0. The amplitude in this case must last for at least three clocking impulses. Parallel to the detection of amplitude, its steepness is detected. When its steepness is at the same time increasing in surges, the required transient signal has been found. The detection of such a signal starts the process. The process is terminated after a predetermined number of clocking impulses. The number of clocking impulses corresponds to at least the time it takes to go from measuring station 1 to measuring station 2.

Figure 2A:
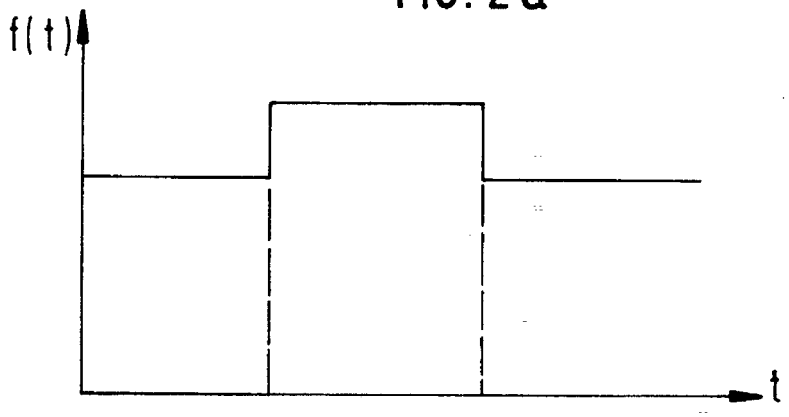
FIG. 2*a* is a representation of a surge signal.
Figure 2B:
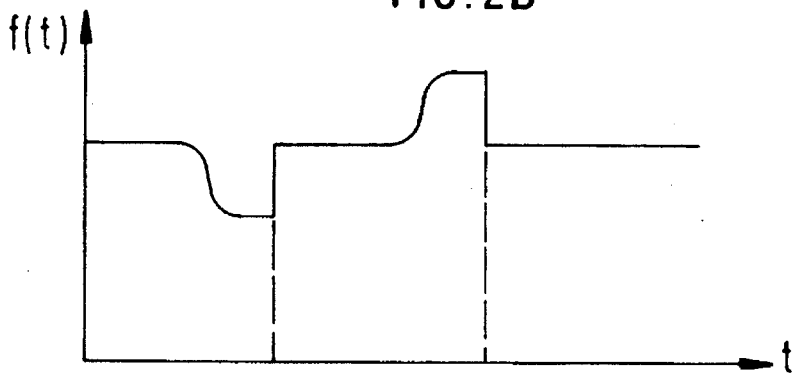
FIG. 2*b* is a representation of reply signal wherein regulation onset is premature.
Figure 2C:
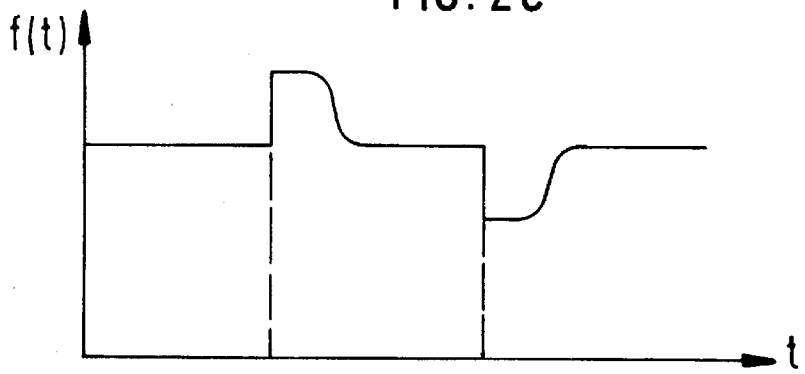
FIG. 2*c* is a representation of a reply signal wherein regulation onset is too late.
Figure 2D:
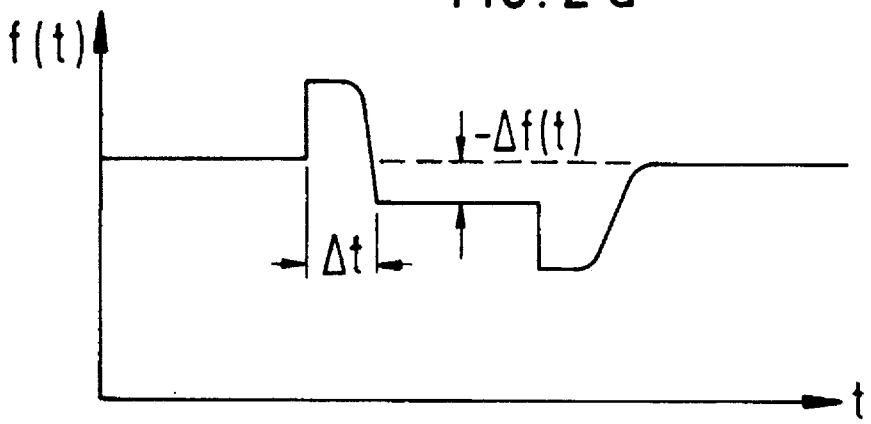
FIG. 2*d* is a representation of response signal wherein regulation onset is premature and amplification is excessive.
Figure 2E:
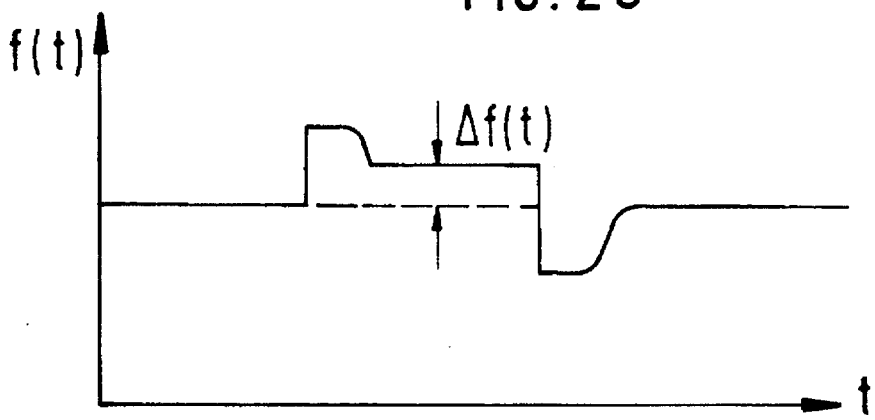
FIG. 2*e* is a representation of a response signal wherein regulation onset is premature and amplification is insufficient.

The process functions parallel to and independently of the existing control system. By connecting the reserve sliver 4, or as a result of random deviation of the fiber sliver thickness, a defined surge signal (represented in an idealized form) according to FIG. 2*a* is triggered. This surge signal is transmitted to measuring station 1 and the course of the output signal over time is detected by means of measuring station 2 at the output of the drawing frame 6. The output signal may for example take on idealized forms as shown in FIGS. 2*b*, 2*c*, 2*d* or 2*e*. The measured-values evaluating unit 8.2 which follows the measuring station 2 has two paths in its output, one path for the control of the regulation onset point, and another path for the control of regulating intensity.

Two amplitudes are detected (FIG. 2*d*) in the processing arm for the control of the regulation onset point in function of the impulse diagram of the response signal of two amplitudes, whereby the first amplitude in progression and phase position is generally used for evaluation. According to FIG. 2 the delay t and the difference –f (t) between the background level of control and the background level of the response signal are evaluated. These values are referred to in the result of the evaluation in component group 8 to rate the effectiveness of regulation. According to FIG. 1 these values are introduced as signals into the measured-values memory 7.1 or into the amplifier 7.2 of the existing regulating system 7 and thus make it possible to correct the parameters in the control system.

The following explanations concerning the feeding of the reserve sliver are given to further facilitate the understanding of the process. With the feeding of the reserve sliver 4, the measuring station 1 registers a sudden increase in fiber sliver thickness. This corresponds to the surge signal. As the leaping signal is detected at the measuring station 1, the regulating circuit 8.1 receives the information on the start of the process. At the same time the measured-value evaluating unit 8.2 starts the mean-value former 8.4. The latter detects first the signals which come into measured-value evaluating unit 8.2 at the measuring station 2 until the arrival of the response signal, i.e. of the corrected sliver. These constituted mean values are stored in the buffer memory 8.5.

As the first flanks of the response signal arrive, the mean value former 8.4 will again form mean values for the period of the response signal's passing. These mean values are however transmitted directly to the comparator 8.6 which now also receives the values from the buffer memory 8.5. The amount difference between the background signal level at the start of the reserve sliver and the background signal level delivered with the response signal is determined in the comparator 8.6. A possible difference found in this comparison corresponds to a measure of regulation intensity. The output of the comparator 8.6 is connected to an amplifier 7.2 which determines the intensity of amplification as a function of the amount difference and its polarity.

Together with the arrival of the flank of the first impulse of the response signal at the measuring station 2, the counting and evaluating unit 8.3 is started through the measured-value evaluating unit 8.2. After the passage of the first impulse of the response signal the counting and evaluating unit 8.3 is again stopped. This result is delivered into the measured-values buffer memory 7.1. The number of time pulses of the first impulse of the response signal supplies the characteristic for the magnitude of the wrong control setting. The phase position (polarity) gives an indication on the direction of the wrong setting, i.e. the onset point of control is too slow with a positive phase position, and too rapid with a negative phase position. The last impulse of the response signal is not taken into consideration. It is always a trailing impulse with a polarity contrary to the first one. The simplicity of this process step consists in the fact that the length of this counted impulse is already a measure for the control application onset point. This characteristic is transmitted to the measured-values memory 7.1 which simultaneously corrects the control application point in function of the characteristic.

It is characteristic for the counting and evaluating unit 8.3 that it is started and stopped by the measured-value evaluating unit 8.2 and that it functions according to a machine-dependent measuring phase 7.4. The machine-dependent setting of the phase 7.4 is synchronized with the fiber sliver speed so that the evaluation of the impulse diagram takes place at the correct moments.

It will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention cover such modifications and variations as come within the scope of the appended claims and their equivalents.

We claim:

1. A correction process for intermittently testing and correcting if necessary a regulation system of a drawing frame for fiber slivers in which drafting is regulated to compensate for thickness fluctuations in the fiber sliver, said correction process comprising:

starting the correction process by intermittently detecting an input transient error signal representing fiber sliver thickness at a measuring point before the sliver enters the drafting zone of the draw frame, said detecting occurring simultaneously and in parallel with continuous measurement of sliver thickness by the regulation system;

detecting and measuring the regulation system response to the input transient error signal at the output of the drafting zone independently of and in parallel with operation of the regulation system, in that continuous regulation by the regulation system is not dependent upon any measured response of the regulation system to the input transient error signal;

evaluating the regulation system response to the input transient error signal independently of and in parallel with the regulation system in that the degree of regulation of the regulation system is not dependent upon said evaluating;

correcting the onset point of regulation or regulation intensity of the regulation system as a factor of the independently evaluated regulation system response to the transient error signal by providing a correction signal to the regulation system; and ending the correction process, and starting the correction process again upon receipt of a subsequent transient error signal.

2. The process as in claim 1, including establishing at lest one threshold value of the input signal representing fiber sliver thickness, the threshold value necessarily being obtained before the input transient error signal is detected by the correction process, said regulation system continuously operating in non-dependance on the threshold value necessary to start said correction process.

3. The process as in claim 2, including establishing threshold values of signal amplitude and steepness.

4. The process as in claim 3, wherein the amplitude of the input signal representing fiber sliver thickness exceeds a threshold value beyond a mean tolerance value of fiber sliver thickness.

5. The process as in claim 3, wherein the amplitude of the input signal representing fiber sliver thickness exceeds the established threshold value for a predetermined period of time.

6. The process as in claim 5, including generating clocking impulses during said detecting of the input signal, the predetermined period of time being at least equal to three clocking impulses of a measured phase.

7. The process as in claim 1, wherein a detected input transient error signal reveals an abnormal condition in the fiber slivers being fed to the drafting zone of the draw frame.

8. The process as in claim 7, further including inducing the input transient error signal with a reserve sliver feeding system which feeds an additional segment of reserve sliver to the slivers being fed to the drafting zone.

9. The process as in claim 1, including routing a measured response signal representing the regulation system response to the input transient error signal through a regulation onset point signal processing path for correction of the regulation system onset point, and through a regulation intensity signal processing path for correction of regulation intensity.

10. The process as in claim 9, wherein the regulation onset point signal processing path determines the actual onset point of regulation in the drafting zone as a function of the time and polarity of amplitude changes of the response signal.

11. The process as in claim 10, further including computing a regulation onset point correction factor as a function of the time and amplitude changes of the response signal, and applying the onset point correction factor to the regulation system.

12. The process as in claim 1, wherein the regulation intensity signal processing path determines a regulation intensity correction factor as a function of the difference between mean values of the input transient error signal and mean values of the regulation response signal, and applies the intensity correction factor to the regulation system.

13. A correction system for monitoring and correcting the regulating system of a draw frame, said correction system operating in parallel with operation of said regulating system, said correction system comprising:

regulating intensity processing means for analyzing the intensity response of said regulating system and computing an intensity correction factor to correct regulating intensity of said regulating system; and regulating onset point processing means for analyzing the actual onset point of regulation of said regulating system and computing an onset point correction factor to adjust the regulating onset point, said intensity processing means and said onset processing means operating independently of and in parallel with said regulating system, said regulating system includes a fiber sliver input measuring station operably before the drafting zone of said draw frame, and a fiber sliver output measuring station operably after the drafting zone of said draw frame, said correction system further comprising:

a control circuit in operable communication with said input measuring station, said control circuit detecting an input fiber sliver transient error signals from said input measuring station and starting the correction process, said control circuit being operationally independent of said regulating system in that said regulating system is dependent upon and continuously measures input sliver thickness and is not dependent upon said transient error signal for continuous regulation;

a measured value evaluating unit in operable communication with said output measuring station to receive a measured response signal indicating the response of said regulating system to the transient error signal, said measured value evaluating unit having two output paths, one said output path to said regulation intensity processing means and the other said output path to said regulation onset point processing means, said control circuit and said measured value evaluating unit being operationally independent from said regulating system in that said regulating system continuously operates is non-dependance upon any input from said control circuit and said measured value evaluating unit;

said regulation onset point processing means comprising a counting and evaluating unit operably configured with said measured value evaluating unit, said counting and evaluating unit operably configured to determine actual onset of regulation of said regulating system without changing regulation onset and to compute a correction factor for onset of regulation as a function of the time and amplitude changes of the response signal of said regulation system, said counting and evaluating unit applying said onset point correction factor to said regulation system, said regulation system changing the onset point of regulation in response to said onset point correction factor; and said regulation intensity processing means comprising processing devices for determining a regulation intensity correction factor as a function of the difference between mean values of the input transient error signal received by said control circuit and mean values of the regulation response signal received by said measured value evaluating unit without effecting regulation intensity of said regulating system, and for applying said intensity correction factor to said regulating system, said regulation system changing regulation intensity in response to said intensity correction factor.

14. The system as in claim 13, wherein said draw frame regulating system includes a measured value memory in communication with said input measuring station, an amplifier receiving signals from said measured value memory, and an adjusting element receiving and applying signals from said amplifier for regulating the drafting of said draw frame, said counting and evaluating unit applying said onset point correction factor to said regulation system through said measured value memory, said regulation intensity processing path applying said intensity correction factor to said adjusting element through said amplifier.

15. The system as in claim 14, wherein said processing devices of said regulation intensity correction processing path comprises a mean value former, a buffer memory, and a mean value comparator, said comparator outputting directly to said amplifier.

16. The system as in claim 13, wherein said draw frame comprises a reserve fiber sliver feeding system, said control circuit operably connected to said reserve fiber sliver feeding system for initiating feeding of a length of reserve fiber sliver thereby generating the input transient error signal detected by said control circuit.

17. An autoleveling draw frame for automatically leveling a band of fiber slivers within a drafting zone, said draw frame comprising:

a regulation system configured to automatically and continuously control the degree of drafting within said drafting zone, said regulation system comprising a fiber sliver input measuring station operably before said drafting zone, a fiber sliver output measuring station operably after said drafting zone;

a correction system configured to operate independent of and in parallel with said regulation system for intermittently determining and correcting the intensity and onset of regulation of said regulation system without said regulation system being dependent upon said correction system for automatic and continuous operation thereof, said correction system further comprising regulating intensity processing means for analyzing the intensity response of said regulating system to an intermittent transient error signal and computing an intensity correction factor to be provided to said regulation system to correct regulating intensity of said regulating system ; and regulating onset point processing means for analyzing the actual onset point of regulation of said regulating system to said intermittent transient error signal and computing an onset point correction factor to be provided to said regulation system to adjust the regulating onset point.

18. The draw frame as in claim 17, wherein said correction system further comprises:

a control circuit in operable communication with said input, measuring station, said control circuit detecting an input fiber sliver transient error signal from said input measuring station and starting the correction process independent of continuous and ongoing operation of said regulation system;

a measured value evaluating unit in operable communication with said output measuring station to receive a response signal from to said transient error signal said regulation system, said regulation system continuously and automatically operating in non-dependence on said response signal and said evaluating unit, said measured value evaluating unit having two output paths, one said output path to said regulation intensity processing means and the other said output path to said regulation onset point processing means;

said regulation onset point processing means comprising a counting and evaluating unit operably configured with said measured value evaluating unit, said counting and evaluating unit operably configured to determine actual onset of regulation said regulation system without effecting onset of regulation and to compute a correction factor for onset of regulation as a function of the time and amplitude changes of the response signal of said regulation system as measured by said measured value evaluating unit, said counting and evaluating unit applying said onset point correction factor to said regulation system;

said regulation intensity processing means comprising processing devices for determining a regulation intensity correction factor as a function of the difference between mean values of the input transient error signal received by said control circuit and mean values of the regulation response signal received by said measured value evaluating unit without effecting regulation intensity, and for applying said intensity correction factor to the regulation system.

19. The draw frame as in claim 18, wherein said regulation system includes a measured value memory in communication with said input measuring station, an amplifier receiving signals from said measured value memory, and an adjusting element receiving and applying signals from said amplifier for regulating the drafting of said draw frame, said counting and evaluating unit applying said onset point correction factor to said regulation system through said measured value memory, said regulation intensity processing path applying said intensity correction factor to said adjusting element through said amplifier.

20. The system as in claim 18, wherein said processing devices of said regulation intensity correction processing path comprises a mean value former, a buffer memory, and a mean value comparator, said comparator outputting directly to said amplifier.

21. The system as in claim 18, wherein said draw frame comprises a reserve fiber sliver feeding system, said control circuit operably connected to said reserve fiber sliver feeding system for initiating feeding of a length of reserve fiber sliver thereby generating the input transient error signal detected by said control circuit.

* * * * *

UNITED STATES PATENT AND TRADEMARK OFFICE

CERTIFICATE OF CORRECTION

PATENT NO : 5,583,781

DATED : DECEMBER 10, 1996

INVENTOR(S) : PETER DENZ ET AL.

It is certified that error appears in the above-identified patent and that said Letters Patent are hereby corrected as shown below:

Claim 13, column 7, line 52, delete "signals" and substitute therefor --signal--.

Claim 18, column 9, line 19, after "input" delete ","; and line 38, after "regulation" insert --of--.

Signed and Sealed this

Twenty-fifth Day of January, 2000

*Attest:*

*Attesting Officer*

*Acting Commissioner of Patents and Trademarks*